US005690215A

United States Patent [19]

Kimball et al.

[11] Patent Number: 5,690,215

[45] Date of Patent: Nov. 25, 1997

[54] DEVICE FOR MAINTAINING THE PARTIAL PRESSURE OF A DISSOLVED GAS IN A FLUID AND RELATED METHODS OF USE

[75] Inventors: Victor E. Kimball, Burnsville; Irvin T. Pierskalla, Robbinsdale, both of Minn.; Christopher H. Porter, Woodinville, Wash.

[73] Assignee: Optical Sensors Incorporated, Minneapolis, Minn.

[21] Appl. No.: 676,945

[22] Filed: Jul. 8, 1996

[51] Int. Cl.[6] ..... B65D 81/28

[52] U.S. Cl. ..... 206/213.1; 206/524.4; 53/449

[58] Field of Search ..... 206/524.1, 524.4, 206/213.1; 53/173, 434, 449

[56] References Cited

U.S. PATENT DOCUMENTS 3,892,058 7/1975 Komatsu et al. .
4,116,336 9/1978 Sorensen et al. .
4,172,152 10/1979 Carlisle ..... 53/449
4,333,516 6/1982 Krueger et al. ..... 206/524.4
4,653,643 3/1987 Black ..... 53/449
4,872,553 10/1989 Suzuki et al. ..... 206/524.4

*Primary Examiner*—David T. Fidei
*Attorney, Agent, or Firm*—Kenneth Barovsky; Bozicevic & Reed

[57] ABSTRACT

A device is provided for maintaining a volume of gas dissolved in a fluid at a predetermined partial pressure. The device includes a first sealable, gas-tight pouch containing the fluid and a second sealable, gas-tight pouch encasing the first pouch and providing a space between the first and second pouches. The space may be charged with an atmosphere containing a volume of the gas dissolved in the fluid that is greater than the volume of dissolved gas, at a partial pressure that is substantially the same as the partial pressure of the dissolved gas. A method is also provided for using the device to maintain a volume of a gas dissolved in a fluid at a predetermined partial pressure.

12 Claims, 1 Drawing Sheet

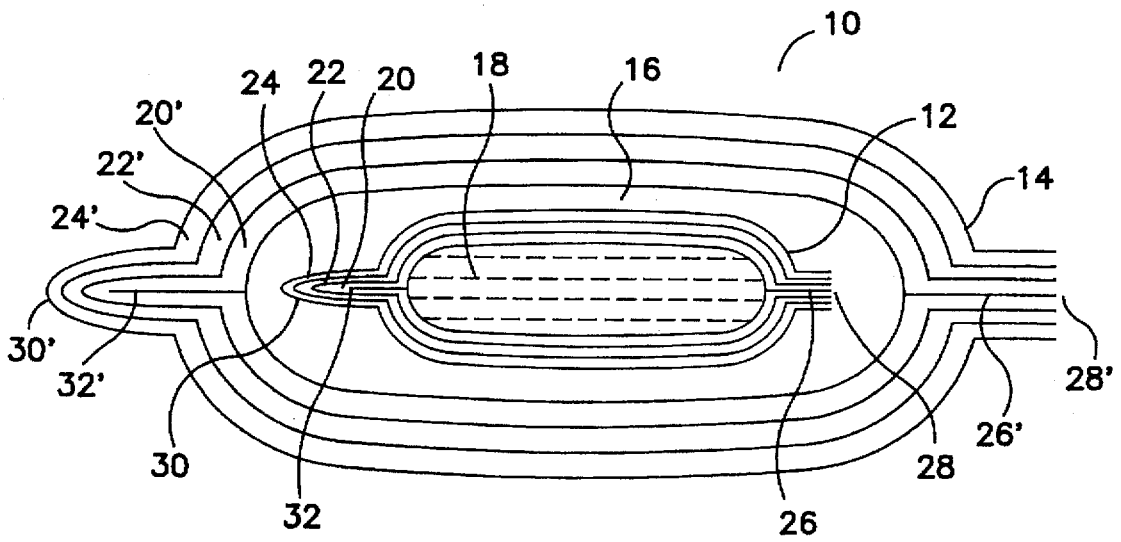
10
24
22
20
18
16
20'
12
22'
14
24'
30'
32'
28'
26'
30
28
32
26

DEVICE FOR MAINTAINING THE PARTIAL PRESSURE OF A DISSOLVED GAS IN A FLUID AND RELATED METHODS OF USE

TECHNICAL FIELD

This invention relates generally to fluid packaging. More particularly, the invention relates to devices for packaging fluids containing dissolved gases and to methods of using such devices to increase the shelf-life of such fluids.

BACKGROUND

Flexible packages are commonly used to contain fluids for convenient and inexpensive storing, transporting and dispensing. For example, flexible packages containing foods, juices, soft drinks and dairy products are available in the retail marketplace. Sterile solutions such as normal saline, dextrose, and the like can also be contained in flexible packages. Similarly, reference fluids that can be used to calibrate and perform quality control measurements on blood gas analysis and other types of medical equipment are often provided in a flexible package.

Typically, a flexible package is fabricated from a polymeric material. Such a material is easily manufactured and fabricated in the form of a package which is readily sterilized. In addition, the package may be made of a metal-plastic laminate. A laminated package made from a layer of a low gas-permeability polymer and a metal foil provides the additional benefit of being substantially gas-impermeable.

The use of a pouch-like container in a method of preparing sterilized, packaged articles is described in U.S. Pat. No. 3,892,058 to Komatsu et al. The container described in Komatsu et al. is a laminate of flexible sheet materials. The inner layer is composed of a heat-sealable resin, such as a polyamide. The outer layer is composed of a heat-resistant resin, such as a polyester film. Sandwiched between the inner and outer layers is a metal foil, such as aluminum.

U.S. Pat. No. 4,116,336 to Sorensen et al., the disclosure of which is incorporated herein by reference, describes the use of a flexible, gas-tight package to contain a fluid containing dissolved $O_2$ and/or $CO_2$. The fluid may be used for calibrating or quality control monitoring of blood gas measuring equipment. The flexible container is a plastic-laminated metal foil, e.g., aluminum. The exterior surface of the metal foil is laminated with a plastic foil, such as a polyester film, to prevent scratching, and the like. The inner surface of the metal foil is laminated with a plastic having low gas permeability and good weldability, such as polyvinylidene chloride or polyethylene terephthalate.

Reference fluids useful for calibrating and performing quality control measurements on blood gas analysis or other medical equipment provide a standard against which the equipment is calibrated with respect to, for example, hydrogen ion concentration (pH) and dissolved oxygen and carbon dioxide partial pressure ($pO_2$ and $pCO_2$, respectively) standards. In order to obtain reliable data from the equipment, it is important that the pH, $pO_2$ and $pCO_2$ values of the reference fluid, once the fluid has been prepared, calibrated, and packaged, be maintained within a specific and very narrow range during shipping and storage. In addition, since many of the reference fluids are used in in vivo or in situ applications, such as with an indwelling arterial catheter, as described in U.S. Pat. No. 4,830,013 to Maxwell, or a paracorporeal system for bedside blood chemistry analysis as described in commonly owned, co-pending U.S. application Ser. No. 08/379,332 to Kimball et al., filed Jan. 27, 1995, entitled "In Situ Calibration System for Sensors Located in a Physiologic Line," both of which are incorporated herein by reference, they must be biocompatible and prepared under sterile conditions, and the sterility of the fluids must be maintained during shipping and storage.

Reference fluids are currently packaged in devices which insure that the gas concentrations will be maintained for the storage lifetime of the package. Such devices include an inner package containing the reference fluid, for example, as described in U.S. Pat. No. 4,116,336 to Sorensen et al. The inner package is sealed in an outer pouch that serves as a sterility barrier. The outer pouch may be, for example, a Tyvek®-backed polymeric material. In addition, the packaging material may be used as a storage medium for shipping the reference fluid.

The flexible packages currently used to contain fluids in which gases have been dissolved suffer from a number of deficiencies. Fluids having gases dissolved therein contained in so-called "gas-tight" flexible packages have a tendency to slowly lose the dissolved gas by diffusion through the package and therefore have a limited shelf-life. Expiration of the shelf-life can result from a change in the partial pressures of the gases dissolved in the fluid to the point that the fluid is no longer usable for calibrating medical equipment and, thus, the package must be discarded.

Accordingly, there remains a need in the art for a flexible packaging device suitable for containing fluids having a gas dissolved therein and for maintaining the partial pressures of the dissolved a gas for prolonged periods of time.

The present invention provides such a device, and involves encasing the fluid-filled pouch in a second pouch. In addition, methods are provided for maintaining the partial pressure of a gas dissolved in a fluid. The device and method produce an unexpectedly large increase in the time that such fluid-filled pouches can be stored prior to use while maintaining the partial pressure of the gas dissolved therein.

SUMMARY OF THE INVENTION

Accordingly, it is a primary object of the invention to address the above-mentioned needs in the art by providing a novel device for containing a fluid having a gas dissolved therein, which has improved storage properties.

It is another object of the invention to provide a device for maintaining a volume of gas dissolved in a fluid at a predetermined partial pressure.

It is a further object to provide a method for using the aforementioned device.

Additional objects, advantages and novel features of the invention will be set forth in part in the description which follows, and in part will become apparent to those skilled in the art upon examination of the following, or may be learned by practice of the invention.

In one aspect of the invention, a device is provided for containing a fluid in which a gas is dissolved, that includes a sealed, gas-impermeable pouch holding the fluid and the gas dissolved therein, and a sealed, gas-impermeable second pouch encasing the first pouch and providing a space between the pouches. The space is charged with an atmosphere containing a volume of the gas dissolved in the fluid that is greater than the volume of dissolved gas, at a partial pressure that is substantially the same as the partial pressure of the dissolved gas.

In still another aspect of the invention, a method is provided for maintaining a volume of gas dissolved in a fluid at a predetermined partial pressure. The method involves providing a sealable, gas-impermeable first pouch containing the fluid and the gas dissolved therein. The first pouch is sealed so as to form a gas-tight, sealed first pouch which is void of any gas phase therein. The sealed first pouch is then encased in a sealable second pouch so as to provide a space therebetween. The space is charged with an atmosphere in which the gas is present at a volume that is greater than the volume of dissolved gas, and at a partial pressure that is substantially the same as the partial pressure of the dissolved gas, and the second pouch is sealed to form a gas-tight, sealed second pouch and a sealed space.

While these devices and methods can be used for a variety of purposes, depending on the components of the fluid contained in the first pouch, they will primarily be used in shipping and storing reference fluids having a predetermined pH, $pO_2$, and/or $pCO_2$ suitable for use in calibrating or performing quality control measurements on blood gas analysis or other medical equipment.

BRIEF DESCRIPTION OF THE DRAWING

In the course of this description, reference will be made to the attached drawings, wherein:

FIG. 1 is a cross-sectional view of a first pouch encased within a second pouch according to the present invention.

DETAILED DESCRIPTION OF THE INVENTION

Definitions:

Before the present devices and methods are disclosed and described, it is to be understood that this invention is not limited to a specific flexible package material, a specific fluid, or particular dissolved gases, as such may, of course, vary. It is also to be understood that the terminology used herein is for the purpose of describing particular embodiments only and is not intended to be limiting.

It must be noted that, as used in the specification and the appended claims, the singular forms "a," "an" and "the" include plural referents unless the context clearly dictates otherwise. Thus, for example, reference to "a gas" includes two or more gases, reference to "a layer" includes two or more such layers, a "pouch" includes two or more pouches, and the like.

In describing and claiming the present invention, the following terminology will be used in accordance with the definitions set out below.

The term "partial pressure" is used in its conventional sense to refer to the pressure exerted by one component of a mixture of gases, or by a gas dissolved in a fluid, if the component or the gas were present alone in a container. The partial pressure of a gas is generally abbreviated as, for example, "$pO_2$" for oxygen, "$pCO_2$" for carbon dioxide, and so forth.

The term "ambient" is used herein to mean standard atmospheric conditions. Thus, the term "ambient pressure" is intended to mean approximately 740 mm Hg to about 780 mm Hg. The term "ambient partial pressure" of a gas is intended to mean the partial pressure of a component of the atmosphere in ambient conditions. Thus, the ambient partial pressure of $O_2$ is approximately 150 mm Hg to 155 mm Hg.

The term "charge" or "charging" as used herein is intended to mean the introduction of an atmosphere or a gas into a space designed to contain the atmosphere or gas. By "charging" a space as such, the atmosphere displaces and replaces the atmosphere that would otherwise be occupying the space. Preferably, charging the space with an atmosphere or a gas displaces and replaces essentially all of the atmosphere otherwise occupying the space. "Charging" a space with an atmosphere or a gas includes but is not limited to introducing an atmosphere or a gas into such a space at ambient or nonambient pressure.

The term "shelf-life" is used herein to mean the time that elapses before a prepared and packaged item, e.g., gas-containing fluid, becomes unusable due to age or deterioration. For example, the shelf-life of a reference fluid containing a volume of a dissolved gas at a predetermined and calibrated partial pressure is determined by the amount of time that elapses before the partial pressure of the gas decreases below a critical level. Typically, the partial pressure of a gas dissolved in a fluid may vary by 0.5% to 3.0%, or as much as 5.0%, and remain in an acceptable range for use as a reference fluid.

A partial pressure that is "substantially the same as" the partial pressure of a gas dissolved in a fluid is intended to mean a partial pressure that is greater than or less than the partial pressure of the dissolved gas by no more than about 25%, preferably by no more than about 10%, and more preferably by no more than about 2.5%.

"Optional" or "optionally" means that the subsequently described circumstance may or may not occur, and that the description includes instances in which said circumstance occurs and instances in which it does not. For example, the phrase "optionally including an additional plastic layer" means that an additional plastic layer may or may not be present, and the description includes both the instance when the additional plastic layer is present and the instance when the additional plastic layer is not present.

The invention, together with additional features and advantages thereof, may best be understood by reference to the following description taken in connection with the illustrative drawing.

With reference to FIG. 1, a device for maintaining the for maintaining a volume of gas dissolved in a fluid at a predetermined partial pressure is shown generally at 10. The device comprises an inner pouch 12 and an outer pouch 14 which encases the inner pouch and provides a space 16 between the inner pouch 12 and the outer pouch 14. Inner pouch 12 is gas-tight and contains a fluid 18 in which a gas has been dissolved. Inner pouch 12 can be of any size and the volume of the fluid 18 contained in the pouch any volume, but typically the size of the pouch is sufficient to contain about 0.5 to about 500 mLs or more. Inner pouch 12 is filled with fluid 18 so that there is no gas phase enclosed within the pouch.

Inner pouch 12 may be fabricated from any flexible gas-tight material or from a laminate of materials. Such a laminate is described in U.S. Pat. No. 4,116,336 to Sorensen et al. In one embodiment, inner pouch 12 is composed of layers 20, 22, and 24 that are laminated together and sealed by, for example, welding the interior layer 20 to form welding seam 26 at edge 28. Preferably, the opposite edge of the bag 30 is also welded along a welding seam 32.

The interior layer 20 of the laminate is preferably a low-permeability plastic, examples of which are well known in the art, and has a thickness of about 25 μm to about 75 μm. Layer 22 is preferably a metal foil, such as aluminum. Optionally, an additional plastic layer may be present between layers 20 and 22 to provide a binder layer. Optional exterior layer 24 is provided as a protective layer over layer 22.

Before inner pouch 12 is sealed, it is filled with a fluid in which a gas is dissolved. One preferred such fluid is a biocompatible reference fluid for use in calibrating or performing quality control measurement on blood gas analysis equipment. The reference fluid may be a medium which contains known analyte concentrations. Such analytes include gases, for example, $O_2$, $CO_2$, $N_2$, argon, helium, or the like, hydrogen ions, i.e., pH, or other biological analytes the presence of which may be desirable to assess in a physiologic fluid, e.g., glucose, potassium, calcium, and the like. In addition, the reference fluid may contain biocompatible buffers including, for example, bicarbonate, phosphate and fluorocarbon-based synthetic buffers. The composition of and methods for preparing reference fluids are well known in the art. Such compositions are described in, for example, U.S. Pat. Nos. 3,380,929 to Petersen, 3,681,255 to Wilfore et al., the disclosures of which are incorporated by reference herein, and U.S. Pat. No. 4,116,336 to Sorensen et al.

Outer pouch 14 is preferably constructed of a laminate of layers 20', 22', and 24' using materials similar to those used in layers 20, 22, and 24 in inner bag 12, and sealed by welding interior layer 20' to form welding seam 26' at edge 28' and a welding seam 32' at opposite edge 30'. However, any flexible, gas-tight package can be used for the outer pouch. Outer pouch 14 is larger than inner pouch 12 so as to encase the inner pouch and to provide a space 16 therebetween. The volume of space 16 is selected so that a volume of the gas in the atmosphere in the space is between 5- and 1000-fold, preferably 50- to 500-fold, more preferably 200- to 300-fold greater than the volume of the gas dissolved in the fluid. The ratio of the volume of gas in the atmosphere to that of the dissolved gas is not intended to be limited by these ranges. One of ordinary skill in the art will recognize that the ratio of the volume of the gas in the atmosphere to the volume of the dissolved gas may be as high as practically possible. Further, it will be recognized that the effect of the device to maintain the partial pressure of the dissolved gas will be enhanced by a greater volume ratio. Prior to sealing the outer pouch, space 16 can be charged with an atmosphere having a predetermined composition and/or an atmosphere at a pressure greater than ambient. Alternatively, the atmosphere in the space may be maintained at a greater-than-ambient pressure by securing to the outer pouch a pressurizing means, such as a clip, an elastomeric band or, preferably, the material in which the pouch is packed for shipping and/or storage.

It has now been discovered by the present inventors that encasing inner pouch 12 in outer pouch 14 and charging space 16 with an atmosphere containing a volume of the gas dissolved in the fluid that is greater than the volume of dissolved gas, at a partial pressure that is substantially the same as the partial pressure of the dissolved gas, prolongs the shelf-life of the fluid an unexpectedly greater amount than would be expected from merely encasing a first pouch within a second pouch. Thus, a reference fluid contained in a flexible package as described in U.S. Pat. No. 4,116,336 to Sorensen et al., and stored at ambient temperature and pressure has a limited shelf-life. Encasing inner pouch 12 in outer pouch 14 and charging space 16 formed therebetween with an appropriate atmosphere having the dissolved gas present with a partial pressure that is substantially the same as the partial pressure of the dissolved gas has been calculated to result in a shelf-life of a year or more.

In order to maintain the partial pressure of the dissolved gas for longer periods of time, the device comprising first pouch 12, second pouch 14, and space 16, can be encased in a third pouch configured so as to provide a space between the second and third pouches. The space is charged with an atmosphere containing the dissolved gas as described above. One of skill in the art will appreciate that additional pouches and spaces will contribute to maintaining the dissolved gas in the fluid for yet longer periods of time. The number of such pouches and spaces is limited only by considerations such as cost and manufacturing practicality.

For example, if the ambient pressure is 743 mm Hg, the ambient $pO_2$ is approximately 152 mm Hg. A single flexible gas-tight pouch containing a buffered, aqueous fluid with a $pO_2$ of about 53 mm Hg has a shelf-life of about seven days. The shelf-life in this instance is defined as the elapsed time for the $pO_2$ of the fluid to change by 0.5 mm Hg. If the pouch is encased in a second pouch to form a space therebetween having a volume of $O_2$ that is ten-fold greater than the volume of dissolved $O_2$, and the space is charged with an atmosphere in which the $pO_2$ is 53 mm Hg, the shelf-life of the bag has been calculated to be approximately 1.25 years. Charging the space with an atmosphere having a $pO_2$ of 48 mm Hg increases the shelf-life to about 3.5 years.

While not wishing to be bound by theory, the increase in the shelf-life of the reference fluid is believed to be the result of a buffering function served by the atmosphere in space 16. Although the flexible packaging material is considered gas-tight, it is clear that some exchange of gas occurs as evidenced by the finite shelf-life of the typical flexible package. By placing the first pouch in a second pouch and charging the space formed therebetween with an atmosphere in which the initial $pO_2$ is substantially the same as the partial pressure of the dissolved gas the rate of exchange of $O_2$ with the ambient $O_2$ will be buffered by the atmosphere in the space. One of ordinary skill in the art will recognize that the difference between the partial pressure of the gas in atmosphere and that of the dissolved gas will vary depending not only on the partial pressure of the dissolved gas but also on the ambient partial pressure of the gas and may range from about 0% to about 25%.

The disclosed device and method for maintaining a volume of gas dissolved in a fluid at a predetermined partial pressure and, thereby, increasing the shelf-life of the fluid are designed to be used with reference fluids for calibrating and performing quality control measurements of blood gas ($O_2$ and $CO_2$) and pH sensors situated in an arterial line in a human or animal subject, as described in commonly owned, co-pending U.S. application Ser. No. 08/379,332 to Kimball et al., filed Jan. 27, 1995, entitled "In Situ Calibration System for Sensors Located in a Physiologic Line." However, utility can be extended to any type of reference fluid or other fluid in which a gas may be dissolved at a predetermined partial pressures that must be maintained within critical tolerance ranges.

Thus, the invention provides novel devices for packaging fluids containing dissolved gases and to methods of using such devices to increase the shelf-life of such fluids. Although preferred embodiments of the subject invention have been described in some detail, it is understood that obvious variations can be made without departing from the spirit and the scope of the invention as defined by the appended claims.

We claim:

1. A device for maintaining a volume of gas dissolved in a fluid at a predetermined partial pressure, comprising a sealed, gas-impermeable first pouch containing the fluid and the gas dissolved therein, and a sealed, gas-impermeable second pouch encasing the first pouch and providing a space therebetween charged with an atmosphere containing the gas, wherein the volume of the gas in the atmosphere is greater than the volume of dissolved gas, and further wherein the partial pressure of the gas in the atmosphere is substantially the same as the partial pressure of the dissolved gas.

2. The device of claim 1, wherein the partial pressure of the gas in the atmosphere is less than the partial pressure of the dissolved gas.

3. The device of claim 1, wherein the partial pressure of the gas in the atmosphere is greater than the partial pressure of the dissolved gas.

4. The device of claim 1, wherein the fluid is a reference fluid for calibration, quality control measurements, or both calibration and quality control measurements of a blood gas analysis apparatus.

5. The device of claim 1, wherein the first pouch comprises a laminate of a metal and a plastic.

6. The device of claim 5, wherein the second pouch comprises a laminate of a metal and a plastic.

7. A method for maintaining a volume of gas dissolved in a fluid at a predetermined partial pressure, comprising (i) providing a sealable, gas-impermeable first pouch containing the fluid and the gas dissolved therein, (ii) sealing the first pouch so as to form a gas-tight, sealed first pouch which is void of any gas phase therein, (iii) encasing the sealed first pouch in a sealable second pouch so as to provide a space therebetween, (iv) charging the space with an atmosphere in which the gas is present, (v) sealing the second pouch to form a gas-tight, sealed second pouch and a sealed space, wherein the volume of the gas in the atmosphere is greater than the volume of dissolved gas, and further wherein the partial pressure of the gas in the atmosphere is substantially the same as the partial pressure of the dissolved gas.

8. The device of claim 7, wherein the partial pressure of the gas in the atmosphere is less than the partial pressure of the dissolved gas.

9. The device of claim 7, wherein the partial pressure of the gas in the atmosphere is greater than the partial pressure of the dissolved gas.

10. The method of claim 7, wherein the fluid is a reference fluid for calibration, quality control measurements, or both calibration and quality control measurements of a blood gas analysis apparatus.

11. The method of claim 7, wherein the first pouch comprises a laminate of a metal and a plastic.

12. The method of claim 11, wherein the second pouch comprises a laminate of a metal and a plastic.

* * * * *